US012398504B2

(12) United States Patent
Lee et al.

(10) Patent No.: US 12,398,504 B2
(45) Date of Patent: Aug. 26, 2025

(54) SYSTEMS AND METHODS FOR DETECTING LINT AGGREGATION IN A DRYER APPLIANCE

(71) Applicant: Haier US Appliance Solutions, Inc., Wilmington, DE (US)

(72) Inventors: Jeonghoon Lee, Gyeonggi-do (KR); Je Kwon Yoon, Seongnam (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 986 days.

(21) Appl. No.: 17/502,781

(22) Filed: Oct. 15, 2021

(65) Prior Publication Data

US 2023/0123590 A1 Apr. 20, 2023

(51) Int. Cl.

| | |
|---|---|
| ***D06F 58/22*** | (2006.01) |
| *D06F 103/56* | (2020.01) |
| *D06F 105/34* | (2020.01) |

(52) U.S. Cl.

CPC ..... *D06F 58/22* (2013.01); *D06F 2103/56* (2020.02); *D06F 2105/34* (2020.02)

(58) Field of Classification Search

CPC ... D06F 58/22; D06F 2103/56; D06F 2105/34
See application file for complete search history.

(56) References Cited

U.S. PATENT DOCUMENTS

| | | | | |
|---|---|---|---|---|
| 3,484,772 | A * | 12/1969 | Niewyk et al. | G01N 15/0618 55/467 |
| 6,411,377 | B1 * | 6/2002 | Noguchi | H01J 37/00 356/237.4 |
| 7,012,685 | B1 * | 3/2006 | Wilson | B01D 46/0086 356/432 |
| 7,040,039 | B1 | 5/2006 | Stein et al. | |
| 8,387,272 | B2 | 3/2013 | Kim et al. | |
| 2001/0025349 | A1 * | 9/2001 | Sharood | G06Q 30/0236 713/340 |
| 2013/0139402 | A1 * | 6/2013 | Hong | D06F 58/50 34/427 |

FOREIGN PATENT DOCUMENTS

| | | | |
|---|---|---|---|
| JP | H03280999 | A | 12/1991 |
| JP | 2020081723 | A | 6/2020 |

* cited by examiner

*Primary Examiner* — Edelmira Bosques
*Assistant Examiner* — Bao D Nguyen
(74) *Attorney, Agent, or Firm* — Dority & Manning, P.A.

(57) ABSTRACT

A dryer appliance includes a drum defining a chamber for receipt of clothes for drying, an air handler for urging a flow of air through the chamber, and a trap duct in fluid communication with the chamber and comprising a lint filter for filtering lint from the flow of air exiting the chamber. A lint detection assembly includes an emitter for generating light and a receiver for detecting the light that is transmitted through the lint filter, and a controller is configured to determine a lint level based at least in part on the light detected by the receiver, determine that the lint level exceeds a predetermined lint threshold, and implementing a responsive action, such as stopping the cycle, notifying the user, and/or updating an initial cycle time.

14 Claims, 6 Drawing Sheets

SYSTEMS AND METHODS FOR DETECTING LINT AGGREGATION IN A DRYER APPLIANCE

FIELD OF THE INVENTION

The present subject matter relates generally to dryer appliances, or more specifically, to systems and methods for detecting lint aggregation in a dryer appliance.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance. Dryer appliances may further include filter systems for removing foreign materials, such as lint, from passing into the exhaust conduit.

Notably, accumulation of lint in the filter systems may lead to reduced airflow through the dryer appliance and poor dryer performance. To compensate for the poor performance, cycle times may need to be increased, resulting in increased energy consumption, higher energy bills, and general consumer dissatisfaction. Moreover, lint build-up may present a fire hazard due to the potential for combustion. Thus, a user of a conventional dryer appliance must periodically remove the lint filter and manually clear the collected lint from the filter. However, users are not frequently aware when lint has built up and the filter needs to be cleaned. For example, conventional dryer appliances have no way of monitoring lint build up and rely on time- or cycle-based indicators that prompt the user to clean the filter.

Accordingly, a dryer appliance with improved methods for detecting lint would be desirable. More specifically, a dryer appliance that can quickly and easily monitor lint levels to facilitate lint removal and maximum dryer performance would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a dryer appliance is provided including a cabinet, a drum rotatably mounted within the cabinet, the drum defining a chamber for receipt of clothes for drying, an air handler for urging a flow of air through the chamber, a trap duct in fluid communication with the chamber and comprising a lint filter for filtering lint from the flow of air exiting the chamber, a lint detection assembly comprising an emitter for generating light and a receiver for detecting the light that is transmitted through the lint filter, and a controller operably coupled to the lint detection assembly. The controller is configured to generate the light using the emitter, detect the light transmitted through the lint filter using the receiver, determine a lint level based at least in part on the light detected by the receiver, determine that the lint level exceeds a predetermined lint threshold, and implement a responsive action in response to determining that the lint level exceeds the predetermined lint threshold.

In another exemplary embodiment, a method of detecting a lint level in a dryer appliance is provided. The dryer appliance includes a lint filter for filtering lint from flow and a lint detection assembly comprising an emitter for generating light and a receiver for detecting the light that is transmitted through the lint filter. The method includes generating the light using the emitter, detecting the light transmitted through the lint filter using the receiver, determining a lint level based at least in part on the light detected by the receiver, determining that the lint level exceeds a predetermined lint threshold, and implementing a responsive action in response to determining that the lint level exceeds the predetermined lint threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
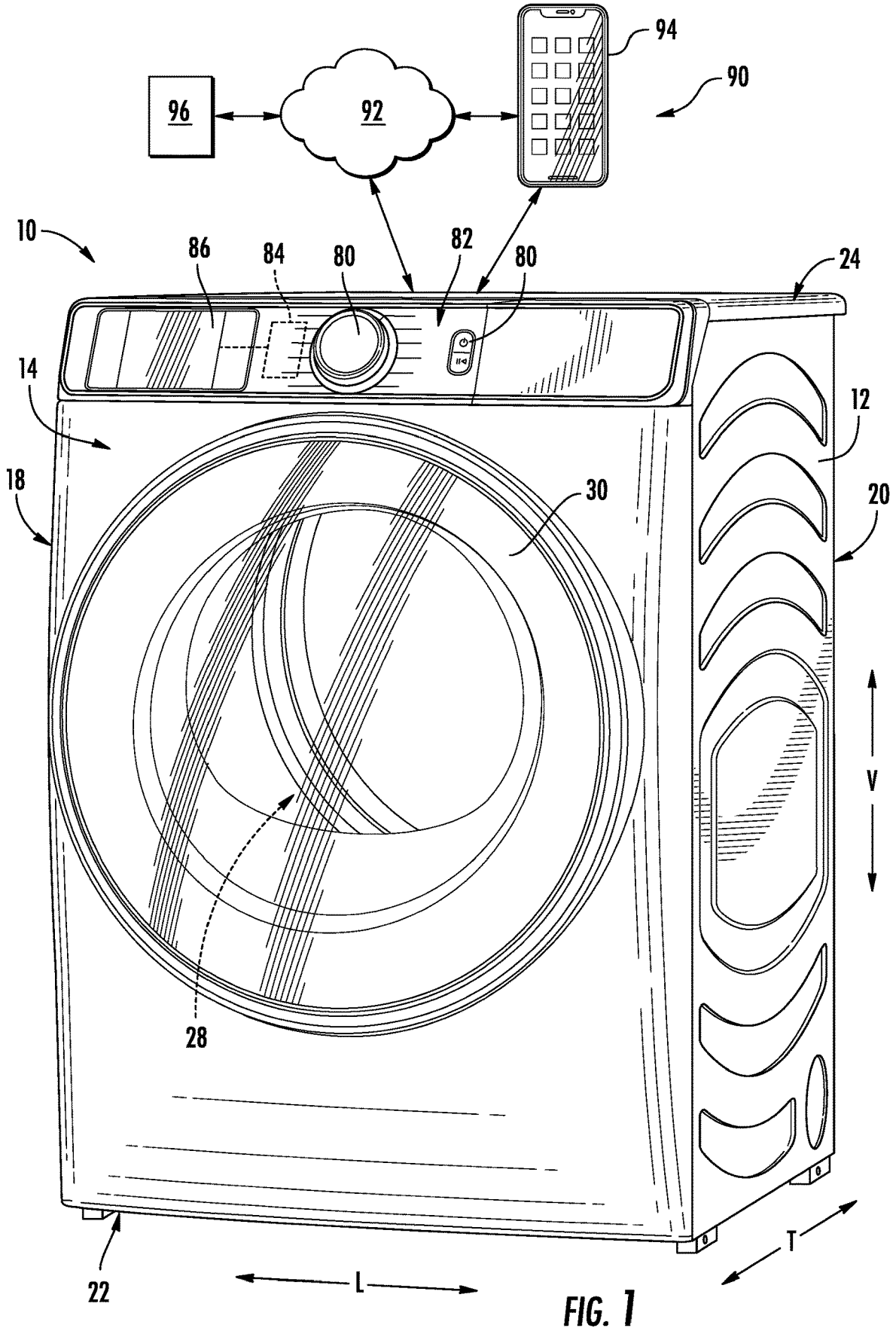
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
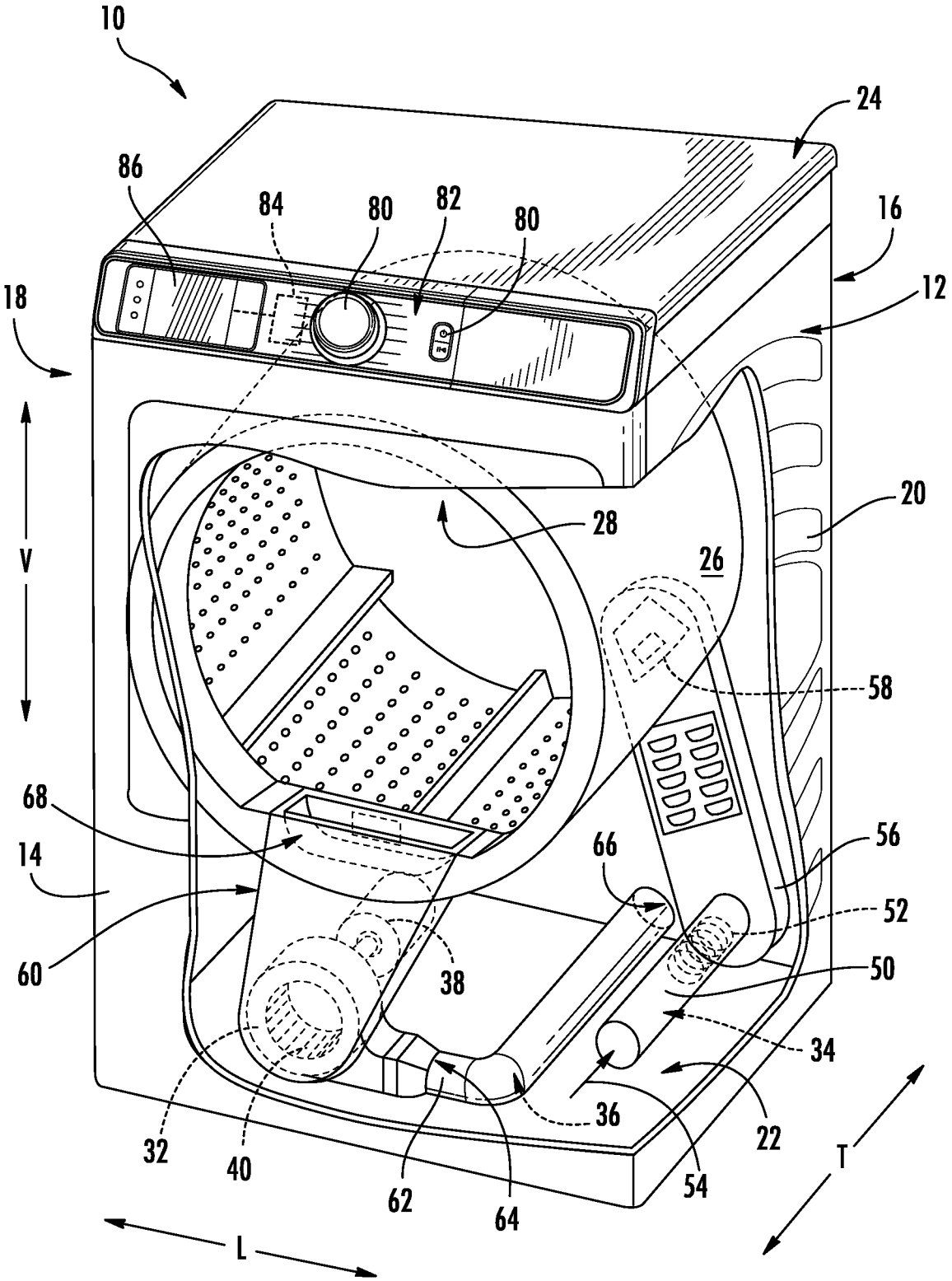
FIG. 2 provides a perspective view of the exemplary dryer appliance of FIG. 1 with portions of a cabinet of the exemplary dryer appliance removed to reveal certain components of the exemplary dryer appliance.

Referring now to the figures, FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances or laundry appliances having different appearances and different features may also be utilized with the present subject matter as well.

According to exemplary embodiments, dryer appliance 10 includes cabinet 12 that is generally configured for containing and/or supporting various components of dryer appliance 10 and which may also define one or more internal chambers or compartments of dryer appliance 10. In this regard, as used herein, the terms "cabinet," "housing," and the like are generally intended to refer to an outer frame or support structure for dryer appliance 10, e.g., including any suitable number, type, and configuration of support structures formed from any suitable materials, such as a system of elongated support members, a plurality of interconnected panels, or some combination thereof. It should be appreciated that cabinet 12 does not necessarily require an enclosure and may simply include open structure supporting various elements of dryer appliance 10. By contrast, cabinet 12 may enclose some or all portions of an interior of cabinet 12. It should be appreciated that cabinet 12 may have any suitable size, shape, and configuration while remaining within the scope of the present subject matter.

As illustrated, dryer appliance 10 generally defines a vertical direction V, a lateral direction L, and a transverse direction T, each of which is mutually perpendicular, such that an orthogonal coordinate system is generally defined. Cabinet 12 includes a front panel 14 and a rear panel 16 spaced apart along the transverse direction T, a pair of side panels 18 and 20 spaced apart from each other along the lateral direction L (e.g., extending between front panel 14 and rear panel 16), and a bottom panel 22 and a top panel 24 spaced apart along the vertical direction V.

Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of inlet duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a trap duct 60, air handler 32, and an exhaust conduit 62. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, trap duct 60 may include a filter portion 68 which includes a screen filter or other suitable device for removing lint and other particulates as internal air is drawn out of chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a user interface panel 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet user interface panel 82. Display 86 may be in communication with controller 84 and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Referring still to FIG. 1, a schematic diagram of an external communication system 90 will be described according to an exemplary embodiment of the present subject matter. In general, external communication system 90 is configured for permitting interaction, data transfer, and other communications with dryer appliance 10. For example, this communication may be used to provide and receive operating parameters, cycle settings, performance characteristics, user preferences, user notifications, or any other suitable information for improved performance of dryer appliance 10.

External communication system 90 permits controller 84 of dryer appliance 10 to communicate with external devices either directly or through a network 92. For example, a consumer may use a consumer device 94 to communicate directly with dryer appliance 10. For example, consumer devices 94 may be in direct or indirect communication with dryer appliance 10, e.g., directly through a local area network (LAN), Wi-Fi, Bluetooth, Zigbee, etc. or indirectly through network 92. In general, consumer device 94 may be any suitable device for providing and/or receiving communications or commands from a user. In this regard, consumer device 94 may include, for example, a personal phone, a tablet, a laptop computer, or another mobile device.

In addition, a remote server 96 may be in communication with dryer appliance 10 and/or consumer device 94 through network 92. In this regard, for example, remote server 96 may be a cloud-based server 96, and is thus located at a distant location, such as in a separate state, country, etc. In general, communication between the remote server 96 and the client devices may be carried via a network interface using any type of wireless connection, using a variety of communication protocols (e.g., TCP/IP, HTTP, SMTP, FTP), encodings or formats (e.g., HTML, XML), and/or protection schemes (e.g., VPN, secure HTTP, SSL).

In general, network 92 can be any type of communication network. For example, network 92 can include one or more of a wireless network, a wired network, a personal area network, a local area network, a wide area network, the internet, a cellular network, etc. According to an exemplary embodiment, consumer device 94 may communicate with a remote server 96 over network 92, such as the internet, to provide user inputs, transfer operating parameters or performance characteristics, receive user notifications or instructions, etc. In addition, consumer device 94 and remote server 96 may communicate with dryer appliance 10 to communicate similar information.

External communication system 90 is described herein according to an exemplary embodiment of the present subject matter. However, it should be appreciated that the exemplary functions and configurations of external communication system 90 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
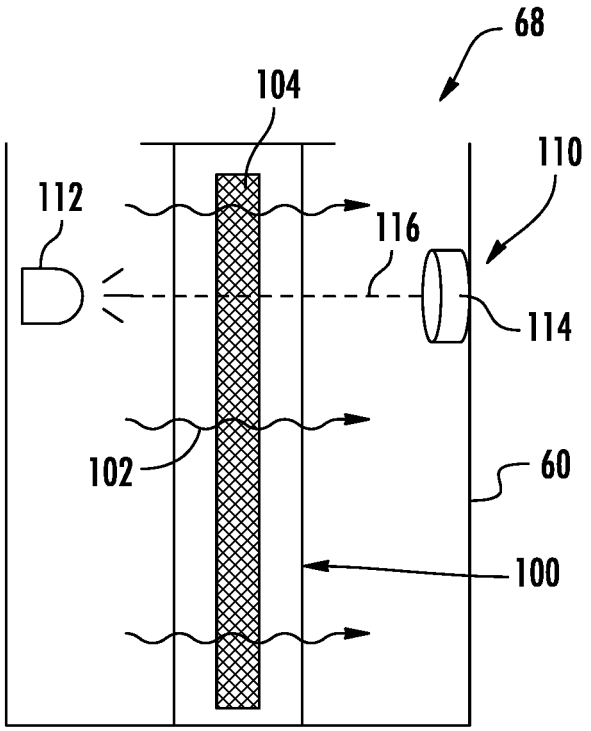
FIG. 3 provides a schematic view of a lint filter and lint detection assembly that may be used with the exemplary dryer appliance of FIG. 1 according to an exemplary embodiment of the present subject matter.
Figure 4:
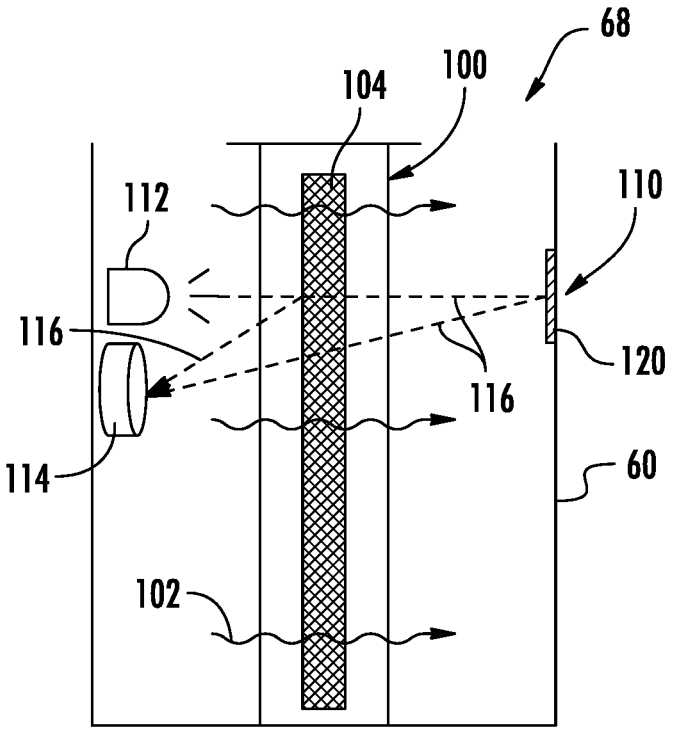
FIG. 4 provides a schematic view of a lint filter and lint detection assembly that may be used with the exemplary dryer appliance of FIG. 1 according to another exemplary embodiment of the present subject matter.

Referring now also generally to FIGS. 3 and 4, filter portion 68 of dryer appliance 10 and appliance mechanisms for filtering air within dryer appliance 10 will be described according to exemplary embodiments of the present subject matter. In general, dryer appliance 10 may include a filter assembly 100 that is removably positioned within filter portion 68 for filtering the flow of air (e.g., as identified herein generally by reference numeral 102) flowing therethrough. Although an exemplary filter assembly 100 is described herein as being positioned within filter portion 68 of dryer appliance 10, it should be appreciated that aspects of the present subject matter may utilize different numbers, types, and configurations of filters oriented within the dryer appliance at other locations.

As shown, filter assembly 100 is removably positioned within filter portion 68 of trap duct 60 for extracting lint, fabric particles, or other debris from the flow of air 102. More specifically, filter assembly 100 may include one or more filter screens or lint filters 104 that may be formed from a porous structure, a mesh screen, or any other suitable structure that permits a flow of air 102 to pass through lint filter 104 while extracting some or all of the particulates or lint from the flow of air 102. In general, filter assembly 100 may be removed from filter portion 68, e.g., to permit a user to manually remove collected lint. As explained briefly above, removing collected lint may improve airflow and dryer performance while reducing safety hazards, e.g., fire hazards associated with the build-up and combustibility of lint.

Although filter assembly 100 is illustrated herein as including a single lint filter 104, it should be appreciated that other filter screen constructions and configurations are possible and within scope the present subject matter. In addition, although schematic illustrations provided herein only illustrate air passing from an unfiltered side of trap duct 60 to a filtered side of trap duct 60, it should be appreciated that other ducting and airflow configurations are possible without departing from the scope of the present subject matter.

As explained above, during operation of dryer appliance 10, the flow of air 102 circulated through chamber 28 to dry the load of clothes will entrain or contain various lint particles that are exhausted through trap duct 60. Filter assembly 100 may remove this lint instead of discharging it from the dryer appliance 10. Filter assembly 100 thus collects the lint for quick and easy removal and disposal. However, conventional dryer appliances rely on passive time- or cycle-based filter cleaning notifications and do not actively monitor or lint build-up. Accordingly, aspects of the present subject matter are directed to methods for detecting the build-up of lint and implementing corrective action to reduce safety hazards, improve appliance performance, and increase customer satisfaction.

Specifically, as best shown in FIGS. 3 and 4, dryer appliance 10 may include a lint detection assembly 110 that is generally configured for monitoring filter assembly 100, identifying lint levels or otherwise detecting the build-up of undesirable amounts of lint. In general, lint detection assembly 110 uses a light source and a light detector to determine the amount of light that is transmitted through lint filter 104 and through any lint collected thereon. As lint builds up on lint filter 104, the amount or intensity of light that passes through filter assembly 100 may be reduced. Aspects of the present subject matter are directed to methods of identifying this light reduction, estimating a lint buildup based on that light reduction, and implementing corrective action.

According to the illustrated embodiment, lint detection assembly 110 includes an emitter 112 and a receiver 114 that are both positioned within filter portion 68 of trap duct 60 or are otherwise adjacent filter assembly 100. In operation, the emitter 112 generates light (e.g., identified herein generally by reference numeral 116) that is detectable by the receiver 114. According to exemplary embodiments of the present subject matter, light 116 is directed through filter assembly 100 and it is the transmission through filter assembly 100 and the corresponding light reduction upon such transmission that may be used to identify lint buildup.

As used herein, the terms "emitter" and the like are generally intended to refer to any suitable source of optical waves, light energy, or electromagnetic energy or radiation. In addition, it should be appreciated that emitter 112 may generate light at any suitable intensity, frequency, wavelength, pattern, etc. Although a single emitter 112 is illustrated herein, it should be appreciated that lint detection assembly 110 may include any other suitable number, type, and configuration of emitters while remaining within the scope of the present subject matter.

In this regard, for example, according to exemplary embodiments, the emitter 112 may include any suitable number, type, position, and configuration of electrical light source(s), using any suitable light technology and illuminating in any suitable color. For example, according to the illustrated embodiment, emitter 112 includes one or more light emitting diodes (LEDs), which may each illuminate in a single color (e.g., white LEDs), or which may each illuminate in multiple colors (e.g., multi-color or RGB LEDs) depending on the control signal from controller 84. However, it should be appreciated that according to alternative embodiments, emitter 112 may include any other suitable traditional light bulbs or sources, such as halogen bulbs, fluorescent bulbs, incandescent bulbs, glow bars, a fiber light source, etc. In addition, it should be appreciated that emitter 112 may operate in either the infrared or visible light range. In this regard, emitter 112 may be an infrared light or transmitter. According to still other embodiments, emitter 112 may operate in an ultraviolet (UV) range.

As used herein, the terms "receiver" and the like are generally intended to be any device suitable for measuring the light 116 generated by emitter 112. For example, receiver 114 may include one or more light sensors, light-dependent resistors, photodiodes, photovoltaic cells, photoresistors, phototransistors, etc. Although a single receiver 114 is illustrated herein, it should be appreciated that lint detection assembly 110 may include any other suitable number, type, and configuration of receivers while remaining within the scope of the present subject matter. In addition, it should be appreciated that emitter 112 and receiver 114 may integrated into a single device.

In addition, as illustrated in FIG. 3, emitter 112 of lint detection assembly 110 transmits light 116 through filter assembly 100 and receiver 114 is positioned on an opposite side of filter assembly 100 for monitoring light 116. However, according to alternative embodiments such as illustrated in FIG. 4, lint detection assembly 110 may detect light reflected by lint that has collected on the lint filter 104. In this regard, a portion of the light 116 may not pass through lint filter 104 and may instead be reflected back and may be detectable by receiver 114.

In addition, or alternatively, lint detection assembly 110 may include a reflector 120 that is positioned at an opposite side of lint filter 104 from both emitter 112 and receiver 114 for reflecting light 116 back through lint filter 104. In this manner, emitter 112 and receiver 114 may be positioned adjacent each other or may be integrated into a single sensor. Reflector 120 may be any object or surface on an opposite side of lint filter 104 that reflects, redirects, or retransmits light 116 back through lint filter 104 toward receiver 114. It should be appreciated that emitter 112, receiver 114, and/or reflector 120 may be positioned within filter portion 68 such that ambient light is blocked and does not affect light measurements or transmission.

According to exemplary embodiments, controller 84 may be in operative communication with lint detection assembly 110 for monitoring lint levels and implementing corrective action. For example, controller 84 may continuously or periodically energize emitter 112 to transmit light 116 through lint filter 104 and may simultaneously monitor the light 116 that passes through lint filter 104 using receiver 114. For example, as described in detail below, controller 84 may adjust cycle operating parameters or cycle time, may notify the user regarding lint conditions, may stop an operating cycle when hazardous conditions exist, etc.

Now that the construction of dryer appliance 10 and the configuration of controller 84 according to exemplary embodiments have been presented, an exemplary method 200 of operating a dryer appliance will be described. Although the discussion below refers to the exemplary method 200 of operating dryer appliance 10, one skilled in the art will appreciate that the exemplary method 200 is applicable to the operation of a variety of other dryer appliances or other devices where a lint filter is used to remove lint from a flow of air. In exemplary embodiments, the various method steps as disclosed herein may be performed by controller 84 or a separate, dedicated controller.

Figure 5:
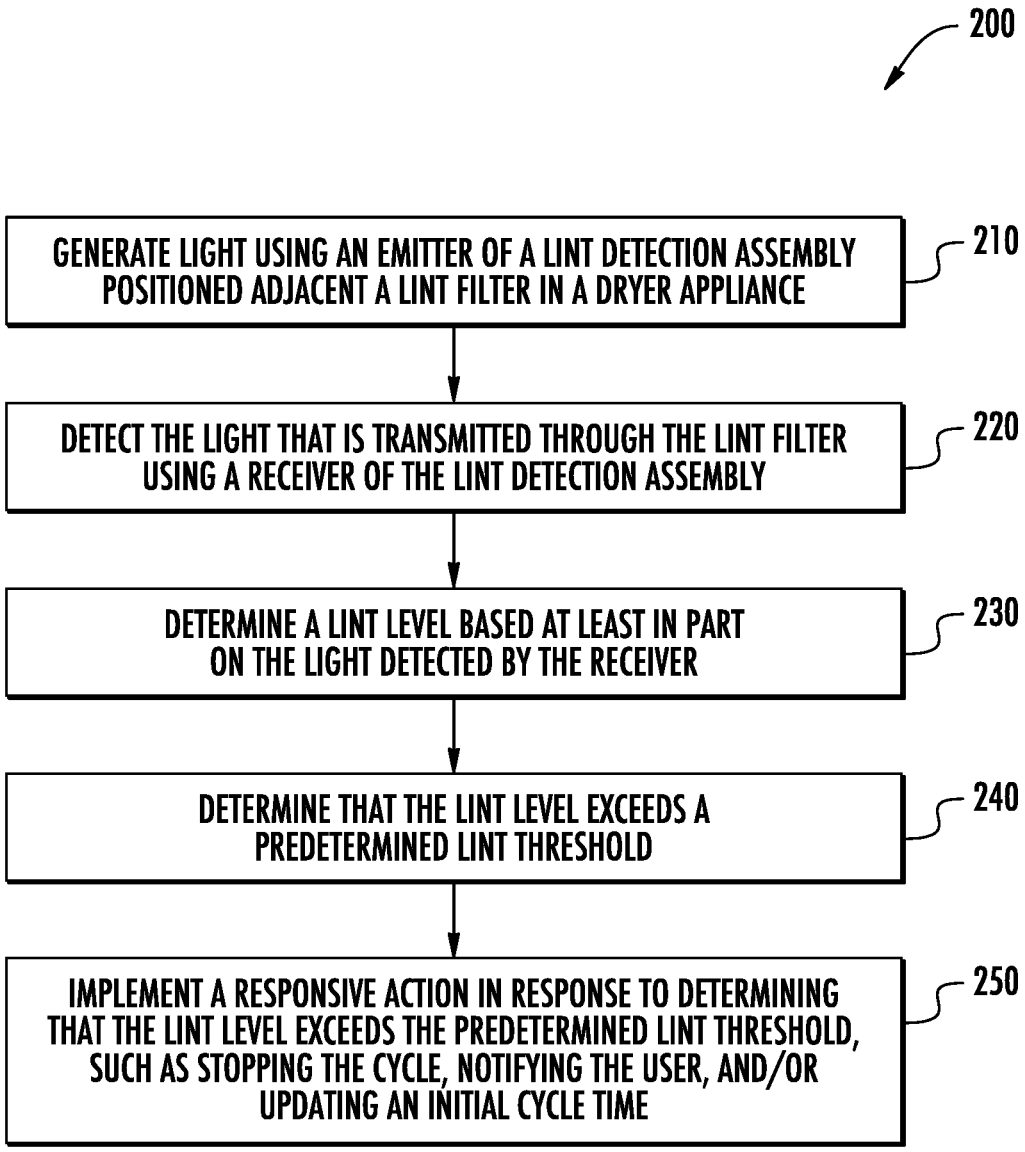
FIG. 5 illustrates a method for operating a dryer appliance in accordance with one embodiment of the present disclosure.

Referring now to FIG. 5, method 200 includes, at step 210, generating light using an emitter of a lint detection assembly positioned adjacent a lint filter in a dryer appliance. In this regard, continuing example from above, emitter 112 of lint detection assembly 110 may generate a beam of light 116 that is directed toward filter assembly 100 such that light 116 is transmitted therethrough to an opposite side of lint filter 104. Step 220 may include detecting the light that is transmitted through the lint filter using a receiver of the lint detection assembly. In this manner, receiver 114 may be used to monitor the light 116 transmitted at step 210.

Figure 6:
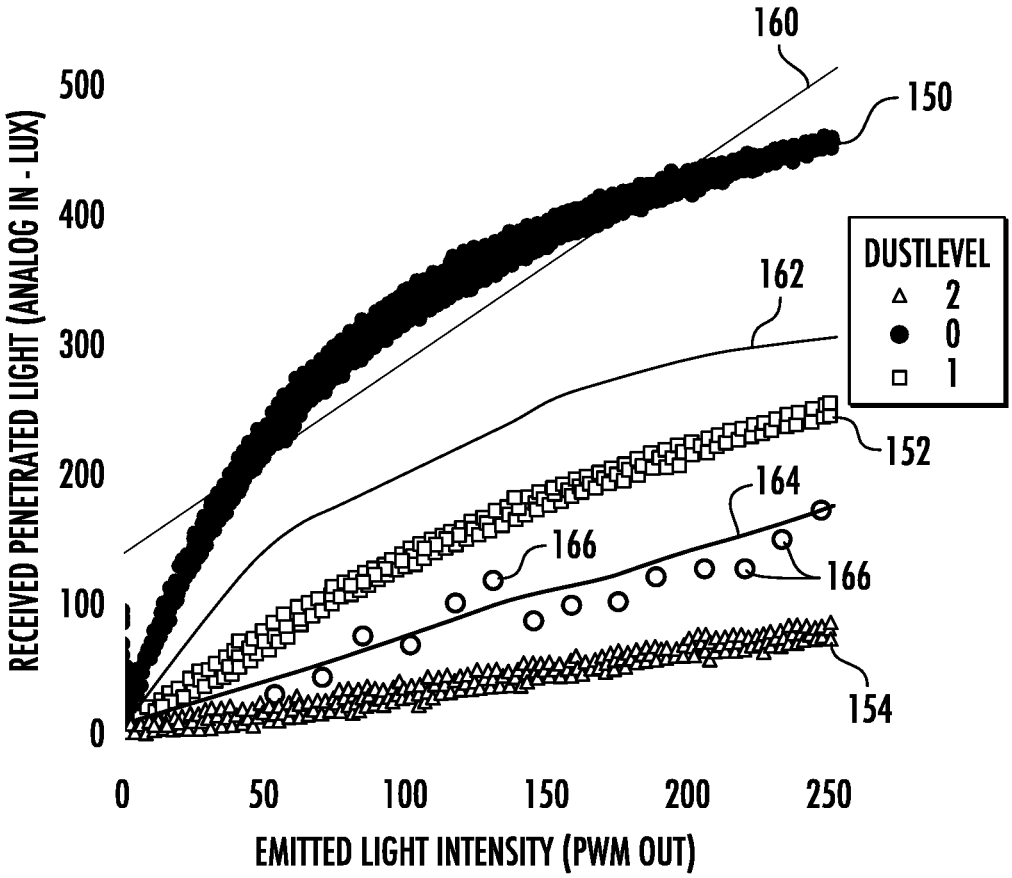
FIG. 6 provides a plot of light detected after passing through a lint filter from a light source at various emission intensities according to an exemplary embodiment.

Step 230 may include determining a lint level based at least in part on the light detected by the receiver. In this regard, for example, the lint level may be determined based on historical or empirical data related to the light transmission when lint filter 104 contains various levels of lint. For example, FIG. 6 provides a plot of light detected by receiver 114 after passing through lint filter 104 from emitter 112 at various emission intensities. As can be seen, elevated dust levels result in less detected light intensity. By having knowledge of this transmission data, controller 84 may determine build up based on the detected light and the known emission intensity. It should be appreciated that this plot data is only exemplary and is not intended to limit the scope of the present subject matter.

For example, as shown in FIG. 6, the first set of data identified by reference numeral 150 may correspond to detected light when the lint filter 104 has just been replaced or is otherwise clean. By contrast, the second set of data identified by reference numeral 152 may correspond detected light when the lint filter has moderate lint buildup and the third set of data identified by reference numeral 154 may correspond to detected light when the lint filter has a heavy lint buildup. Using this data, controller 84 may know based on the emitted light intensity and the detected light how much lint is present on lint filter 104.

Step 240 may include determining that the lint level exceeds a predetermined lint threshold. Although exemplary thresholds are described herein, it should be appreciated method 200 may include any suitable number of thresholds at any suitable levels to facilitate improved dryer performance and safety. For example, referring again briefly to FIG. 6, controller 84 may be programmed with trend lines that are derived from data 150-152. In this regard, line 160 may correspond to a low level threshold of lint, line 162 may correspond to a moderate level threshold of lint, and line 164 may correspond to a high level threshold of lint. Controller 84 may vary the intensity of light to generate a plurality of data points as identified generally by reference numeral 166. These data points 166 may be classified based in part on where they fall relative to lines 160-164. As shown in FIG. 6, the average data point falls below high level threshold line 164. Accordingly, controller 84 may classify the lint filter 104 as having high levels of lint and make take corrective action.

Notably, method 200 may include implementing corrective action based on the detected lint levels, particularly with respect to the lint level thresholds. Specifically, step 250 may include implementing a responsive action in response to determining that the lint level exceeds the predetermined lint threshold. It should be appreciated that the corrective action taken when each threshold is reached may vary, such that more aggressive responsive actions are taken when the lint buildup gets more extreme. For example, referring again to the data points 166 illustrated in FIG. 6, under this condition, controller 84 may deduce that there is extreme buildup of lint and that corrective action should be taken (e.g., such as stopping an operating cycle and notifying the user).

As explained above, controller 84 may be configured to operate in a manner to generate light at a plurality of light intensities and can detect light transmitted through the lint filter at each of those light intensities. Based on this detected light, controller 84 may determine a lint level. As shown in FIG. 6, this determination process may use general data analysis and control algorithms, such as parametric boundaries, linear regressions, and other mathematical functions. By contrast, according to another exemplary embodiment, this determination may include the use of a machine learning image recognition process to identify a lint level, e.g., based on the light detected in various emission frequencies. It should be appreciated that any suitable image processing or recognition method may be used to analyze this data (e.g., or the plot of this data as shown in FIG. 6) to facilitate determination of the lint level. In addition, it should be appreciated that this image analysis or processing may be performed locally (e.g., by controller 84) or remotely (e.g., by a remote server).

Accordingly, step 250 may include implementing a responsive action in response to determining that the lint level exceeds the predetermined lint threshold. In general, the responsive action may be intended to improve dryer performance, increase the appliance safety, and keep the user informed regarding operating conditions. Although exemplary responsive actions are described below, it should be appreciated that variations and modifications may be made to step 250 while remaining within scope the present subject matter.

For example, according to an exemplary embodiment, implementing the responsive action may include adjusting one or more operating parameters of the dryer operating cycle. For example, the temperature of the flow of air may be adjusted, the initial cycle time may be adjusted, etc. In this regard, controller 84 may be programmed to predict the cycle time required to dry load of clothes, e.g., based on the cycle parameters selected, the load type, etc. However, this cycle time is commonly based on an assumption of a clean lint filter. Accordingly, when high lint levels are detected, controller 84 may be programmed to extend the initial cycle time to more appropriately predict the amount of time required to dry the load of clothes. In addition, or alternatively, the operating cycle of the dryer may be stopped, particularly in the event that the lint level has exceeded an elevated threshold, thus being indicative of dangerous operating conditions.

In addition, step 250 of implementing a responsive action may further include providing a user notification that that the lint level exceeds the predetermined lint threshold. In addition, this user notification may include useful information such as estimated lint levels, updated cycle times, and/or suggested responsive action. It should be appreciated that the user notification may be provided to the user from any suitable source and in any suitable manner. For example, according to exemplary embodiments, the user notification may be provided through control panel 82 so that the user may be aware of the issue (e.g., such as via an illuminated warning indicator, an image displayed on a screen, etc.). In addition, or alternatively, controller 84 may be configured to provide a user notification to a remote device, such as remote device 94 via a network 92. Whether provided via control panel 82, remote device 94, or by other means, this user notification may include useful information regarding the lint level or other useful information. For example, the user notification may include a pop-up notification on a user's cell phone or other remote device and may suggest or prompt the user regarding remedial action.

Notably, method 200 may further include taking no action when the lint level is sufficiently low. In this regard, method 200 may include determining that the lint level is below the predetermined lint threshold and continuing with a normal operating cycle, e.g., such as performing a drying cycle with the originally determined cycle time and parameters.

Figure 7:
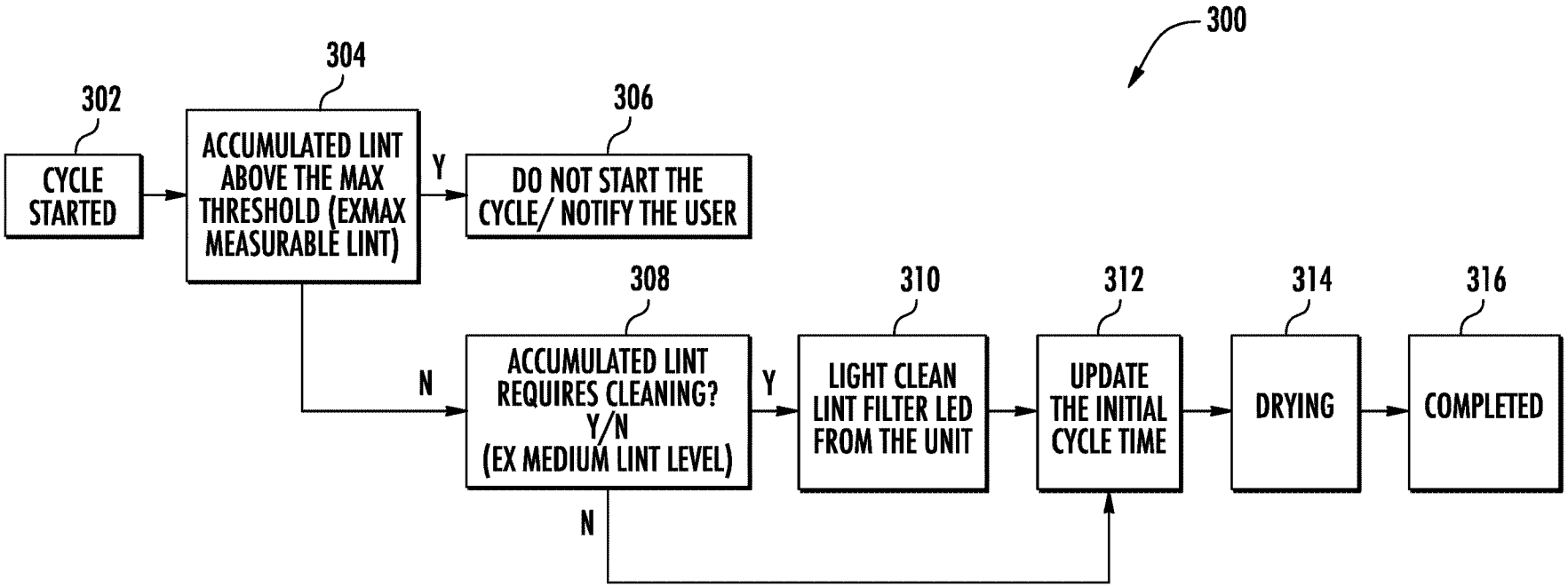
FIG. 7 provides a flow diagram illustrating an exemplary lint detection process according to an exemplary embodiment of the present subject matter.

Referring now briefly to FIG. 7, an exemplary flow diagram of a lint detection method 300 that may be implemented by dryer appliance 10 will be described according to an exemplary embodiment of the present subject matter. According to exemplary embodiments, method 300 may be similar to or interchangeable with method 200 and may be implemented by controller 84 of dryer appliance 10. As shown, at step 302, controller 84 may first start an operating cycle of a dryer appliance.

Step 304 may include using lint detection assembly 110 to detect a lint level within filter assembly 100. In addition, step 304 may include determining that the lint level is above the maximum threshold, e.g., is above a maximum allowed lint level. In the event that the lint level exceeds this maximum acceptable threshold, method 300 may further include, at step 306 stopping or not starting the operating cycle, notifying the user, and/or locking out the dryer appliance until corrective action is taken.

By contrast, if the accumulated lint has not exceeded the maximum safety threshold, step 308 may include determining whether the accumulated lint requires cleaning. In this regard, lint levels that exceed the medium threshold or higher may be require cleaning. If the lint level exceeds this predetermined threshold, step 310 may include illuminating a clean filter indicator or otherwise notifying a user that the filter needs to be cleaned. Step 312 may include updating the initial cycle time based on the lint level. As shown, this step may be performed whether the lint level exceeds the predetermined threshold (e.g., medium level or higher lint buildup) or falls below the predetermined threshold (e.g., low lint buildup). Step 314 may include proceeding with the drying cycle and 316 may include completing the cycle.

FIGS. 5 and 7 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using dryer appliance 10 as an example, it should be appreciated that this method may be applied to the operation of any suitable laundry appliance, such as another dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dryer appliance, comprising:

a cabinet;

a drum rotatably mounted within the cabinet, the drum defining a chamber for receipt of clothes for drying;

an air handler for urging a flow of air through the chamber;

a trap duct in fluid communication with the chamber and comprising a lint filter for filtering lint from the flow of air exiting the chamber;

a lint detection assembly comprising an emitter for generating light and a receiver for detecting the light that is transmitted through the lint filter; and a controller operably coupled to the lint detection assembly, the controller being configured to:

generate the light using the emitter;

detect the light transmitted through the lint filter using the receiver;

determine a lint level based at least in part on the light detected by the receiver;

determine that the lint level exceeds a predetermined lint threshold;

implement a responsive action in response to determining that the lint level exceeds the predetermined lint threshold; and adjust an initial cycle time based at least in part on the lint level detected by the lint detection assembly.

2. The dryer appliance of claim 1, wherein the emitter and the receiver are positioned within the trap duct on opposite sides of the lint filter.

3. The dryer appliance of claim 1, wherein the emitter comprises one or more light emitting diodes and the receiver comprises a light sensor.

4. The dryer appliance of claim 1, wherein the emitter generates the light having at a wavelength in a visible light range, an infrared light range, or an ultraviolet light range.

5. The dryer appliance of claim 1, wherein the lint detection assembly comprises:

a reflector positioned at an opposite side of the lint filter from the emitter and the receiver for reflecting the light back through the lint filter, wherein the receiver is positioned adjacent the emitter for detecting the light that is reflected through the lint filter.

6. The dryer appliance of claim 1, wherein implementing the responsive action comprises:

providing a user notification that the lint level exceeds the predetermined lint threshold or that filter cleaning is recommended.

7. The dryer appliance of claim 6, further comprising:

a user interface panel, wherein the user notification is provided through the user interface panel.

8. The dryer appliance of claim 6, wherein the controller is in operative communication with a remote device through an external network, and wherein the user notification is provided through the remote device.

9. The dryer appliance of claim 1, wherein the controller is further configured to:

determine that the lint level is below the predetermined lint threshold; and proceed with a drying cycle of the dryer appliance.

10. The dryer appliance of claim 1, wherein the controller is further configured to:

determine that the lint level is above a maximum allowed lint level; and stop an operating cycle of the dryer appliance in response to determining that the lint level is above the maximum allowed lint level.

11. The dryer appliance of claim 1, wherein the controller is further configured to:

operate the emitter to generate the light at a plurality of light intensities;

detect the light transmitted through the lint filter at each of the plurality of light intensities; and determine a lint level based at least in part on the light detected by the receiver at each of the plurality of light intensities.

12. The dryer appliance of claim 11, wherein the controller is further configured to:

generate a plot of the plurality of light intensities and the light detected at each of the plurality of light intensities; and analyze the plot using a machine learning image recognition process to determine the lint level.

13. The dryer appliance of claim 11, wherein the controller is further configured to:

generate a plot of the plurality of light intensities and the light detected at each of the plurality of light intensities; and analyze the plot using comparisons with parametric boundaries to determine the lint level.

14. A dryer appliance, comprising:

a cabinet;

a drum rotatably mounted within the cabinet, the drum defining a chamber for receipt of clothes for drying;

an air handler for urging a flow of air through the chamber;

a trap duct in fluid communication with the chamber and comprising a lint filter for filtering lint from the flow of air exiting the chamber;

a lint detection assembly comprising an emitter for generating light and a receiver for detecting the light that is transmitted through the lint filter; and a controller operably coupled to the lint detection assembly, the controller being configured to:

generate the light using the emitter;

detect the light transmitted through the lint filter using the receiver;

determine a lint level based at least in part on the light detected by the receiver, wherein determining the lint level comprises generating a plot of the plurality of light intensities and the light detected at each of the plurality of light intensities and analyzing the plot using comparisons with parametric boundaries;

determine that the lint level exceeds a predetermined lint threshold; and implement a responsive action in response to determining that the lint level exceeds the predetermined lint threshold.

* * * * *